US010969159B2

(12) United States Patent
Cizik et al.

(10) Patent No.: US 10,969,159 B2
(45) Date of Patent: Apr. 6, 2021

(54) DOMESTIC REFRIGERATION APPLIANCE APPARATUS

(71) Applicant: BSH HAUSGERAETE GMBH, Munich (DE)

(72) Inventors: Herbert Cizik, Ottenbach (DE); Jessica Dittmann, Lauchheim (DE); Bernd Pfister, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/488,570

(22) Filed: Apr. 17, 2017

(65) Prior Publication Data

US 2017/0307285 A1 Oct. 26, 2017

(30) Foreign Application Priority Data

Apr. 25, 2016 (DE) ..... 10 2016 206 978.0

(51) Int. Cl.

| | |
|---|---|
| ***F25D 11/02*** | (2006.01) |
| ***F25D 25/02*** | (2006.01) |
| ***F25D 17/06*** | (2006.01) |
| ***F25D 25/00*** | (2006.01) |
| ***A47B 88/919*** | (2017.01) |
| ***F25D 23/02*** | (2006.01) |

(52) U.S. Cl.

CPC ..... *F25D 25/025* (2013.01); *A47B 88/919* (2017.01); *F25D 11/02* (2013.01); *F25D 17/06* (2013.01); *F25D 23/021* (2013.01); *F25D 25/005* (2013.01); *A47B 2210/175* (2013.01); *F25D 2317/061* (2013.01)

(58) Field of Classification Search

CPC ..... F25D 25/025; H05K 7/20145

See application file for complete search history.

(56) References Cited

U.S. PATENT DOCUMENTS

2006/0005567 A1* 1/2006 Lee ..... F25D 17/045 62/408
2009/0199587 A1* 8/2009 Matthews ..... F25D 17/042 62/448
2010/0319374 A1 12/2010 Ihle et al.

FOREIGN PATENT DOCUMENTS

CN 1714264 A 12/2005
CN 101946140 A 1/2011

(Continued)

OTHER PUBLICATIONS

Jin, Vegetable Tray for Refrigerator, 2002, Full Document (Year: 2002).*

*Primary Examiner* — Elizabeth J Martin
*Assistant Examiner* — Nael N Babaa
(74) *Attorney, Agent, or Firm* — Laurence A. Greenberg; Werner H. Stemer; Ralph E. Locher

(57) ABSTRACT

A domestic refrigeration appliance apparatus has a storage unit which defines at least one storage chamber for storing food that is open in the direction of an upper face of the storage unit, a closing unit which in at least one first storage state closes the storage unit at least substantially in the direction of the upper face, and a ventilation unit which in at least one second storage state moves the closing unit relative to the storage unit to ventilate the storage chamber. In order to provide a generic apparatus with improves properties in respect of efficient ventilation of a storage chamber, it is proposed that the ventilation unit pivots the closing unit about at least one pivot axis relative to the storage unit to ventilate the storage chamber.

7 Claims, 6 Drawing Sheets

(56) References Cited

FOREIGN PATENT DOCUMENTS

| | | | | | |
|---|---|---|---|---|---|
| CN | 103477166 | A | | 12/2013 | |
| DE | 19751309 | A1 | | 5/1999 | |
| DE | 102008010520 | A1 | | 9/2009 | |
| DE | 102013225090 | A1 | | 6/2015 | |
| EP | 2662648 | A1 | | 11/2013 | |
| JP | 2000146406 | A | | 5/2000 | |
| KR | 20020051135 | A | * | 6/2002 | ..... F25D 25/025 |

* cited by examiner

DOMESTIC REFRIGERATION APPLIANCE APPARATUS

CROSS-REFERENCE TO RELATED APPLICATION

This application claims the priority, under 35 U.S.C. § 119, of German application DE 10 2016 206 978.0, filed Apr. 25, 2016; the prior application is herewith incorporated by reference in its entirety.

BACKGROUND OF THE INVENTION

Field of the Invention

The invention relates to a domestic refrigeration appliance apparatus.

A domestic refrigeration appliance apparatus is already known from the prior art, having a storage unit, which defines a storage chamber for storing food that is open in a direction of an upper face of the storage unit. In a first storage state the storage chamber is completely closed by a closing unit. In a second storage state a ventilation unit moves the closing unit by a translatory movement relative to the storage unit to ventilate the storage chamber. In a first configuration the ventilation unit moves the closing unit in a horizontal direction, which is aligned parallel to a base, relative to the storage unit. In an alternative second configuration the ventilation unit has a slotted guide, which is arranged on a side wall bounding a refrigeration chamber. The ventilation unit here moves the closing unit in a direction at an angle to the storage unit.

SUMMARY OF THE INVENTION

The object of the invention is in particular to provide a generic apparatus with improved properties in respect of efficient ventilation of a storage chamber. According to the invention the object is achieved by the features of the main claim, while advantageous configurations and developments of the invention will emerge from the subclaims.

The invention is based on a domestic refrigeration appliance apparatus with a storage unit, which defines at least one storage chamber for storing food that is open in the direction of an upper face of the storage unit, with a closing unit, which, in at least one first storage state, closes the storage unit at least substantially in the direction of the upper face and in particular completely taking into account at least one sealing tolerance, and with a ventilation unit, which, in at least one second storage state, moves the closing unit relative to the storage unit to ventilate the storage chamber.

It is proposed that the ventilation unit pivots the closing unit about at least one pivot axis, in particular about just one pivot axis, relative to the storage unit, to ventilate the storage chamber.

A "domestic refrigeration appliance apparatus" refers in particular to at least one part, in particular a subassembly, of a domestic refrigeration appliance. The domestic refrigeration appliance is particularly advantageously provided to chill chilled goods, in particular food, such as for example beverages, meat, fish, milk and/or dairy products, in at least one operating state, in particular to preserve the chilled goods for longer. The domestic refrigeration appliance can be in particular a refrigerator and advantageously a chiller and/or freezer.

In particular the storage unit forms at least one boundary wall of the storage chamber. The storage unit in particular has an at least substantially trough-like configuration. The storage unit forms in particular at least one refrigeration compartment. For example the storage unit could form a chiller compartment and/or a vegetable compartment and/or a fruit compartment and/or a meat compartment and/or a keep-fresh compartment. An "upper face" of an object refers in particular to a face which faces away from a base in an installed position. The base could be in particular a bottom, in particular a floor and/or a storage surface, which could in particular be formed at least partially by the bottom.

In the first storage state the closing unit and the storage unit define the storage chamber at least substantially and advantageously completely taking into account at least one sealing tolerance. The closing unit is configured in particular as a lid. For example the closing unit could be configured as a single part and/or as a single piece. Alternatively the closing unit could be configured in at least two parts, in particular in two parts and/or multiple parts, with in particular individual parts, in particular elements and/or units of the closing unit, being able to be arranged at least substantially immovably relative to one another. The closing unit is in particular free of openings and/or cutouts, which are provided in particular to ventilate the storage chamber.

A "ventilation unit" refers in particular to a unit, which is provided to pivot the closing unit relative to the storage unit in the second storage state and in particular to open the storage chamber at least partially by the pivot movement of the closing unit relative to the storage unit, in order to allow in particular an exchange of fluid, in particular an exchange of air, between the storage chamber and its surroundings. The ventilation unit distances the closing unit in at least one region, in particular in at least one side region, from the storage unit in particular in the second storage state.

In particular the ventilation unit is provided to pivot the closing unit relative to the storage unit and in particular to arrange it in different positions relative to the storage unit. In particular the ventilation unit is provided to pivot the closing unit from the first storage state relative to the storage unit and in particular to move it to the second storage state. In particular the ventilation unit is provided to pivot the closing unit from the second storage state relative to the storage unit and in particular to move it to the first storage state.

In the first storage state the closing unit is arranged in particular in a first pivot position relative to the storage unit. In the second storage state the closing unit is arranged in particular in a second pivot position, which is different from the first pivot position, relative to the storage unit. The ventilation unit in particular moves the closing unit reversibly between the first pivot position and the second pivot position relative to the storage unit. The ventilation unit is provided in particular to arrange and/or fix the closing unit in at least one, in particular arbitrary, intermediate position relative to the storage unit. The intermediate position is in particular a position between the first pivot position and the second pivot position.

"Provided" means in particular programmed, designed and/or equipped. That an object is provided for a specific function means in particular that the object fulfils and/or performs the specific function in at least one application and/or operating state.

The inventive configuration allows in particular efficient ventilation of a storage chamber to be achieved. In particular efficient storage of food, in particular in respect of long term preservation, can be achieved. In particular available space can be used optimally. The storage chamber can in particular be ventilated specifically, allowing in particular the preservation of food for a particularly long time. In particular it allows optimally tailored and/or dosed ventilation of the storage chamber. In particular a high quality rating can be achieved. For example an optical display can in particular allow simple monitoring of a position of the closing unit relative to the storage unit. In particular an opening width of the closing unit relative to the storage unit can be set in an at least substantially infinitely adjustable or continuous manner. Alternatively or additionally the opening width of the closing unit relative to the storage unit can be set in steps or discontinuously. For example there can be two or three settings for the opening width, so that a setting can be stepped over two steps or three steps. The three steps can be referred to for example as closed, half-open and fully open. The two steps can be differentiated for example as "closed" and "open". It is also possible to have four, five or six steps for a setting.

It is further proposed that the ventilation unit provides a lifting force acting on a side region of the closing unit for ventilation. At the start of the pivot movement of the closing unit relative to the storage unit the lifting force is aligned in particular at least substantially perpendicular to a main extension plane of the closing unit. A "main extension direction" of an object here refers in particular to a direction running parallel to a longest edge of a smallest notional geometric cuboid, which just encloses the object completely. In particular in the second storage state the ventilation unit raises the closing unit, in particular at least the side region of the closing unit, relative to the storage unit, and in particular pivots the closing unit about the pivot axis. In particular the pivot axis, in particular when viewing the closing unit and the storage unit from above at least in the first storage state, is arranged on a further side region of the closing unit opposite the side region. A "side region" of an object refers in particular to a region which, when the object is viewed from above, extends in proximity to a lateral boundary of the object. When the closing unit is viewed from above the side region is in particular at a distance of maximum 10 cm, in particular maximum 7 cm, advantageously maximum 5 cm and preferably maximum 3 cm from a lateral boundary of the closing unit. When the closing unit is viewed from above the side region is in particular at a distance of maximum 25%, in particular maximum 15%, advantageously maximum 10% and preferably maximum 5% of an extension of the closing unit, which is aligned in particular perpendicular to the lateral boundary of the closing unit, from a lateral boundary of the closing unit. An "extension" of an object refers in particular to a maximum distance between two points of a perpendicular projection of the object onto a plane. This in particular allows particularly advantageous ventilation properties to be achieved.

It is also proposed that the ventilation unit has a transmission unit and provides the lifting force by means of the transmission unit. The transmission unit is provided in particular to change at least one movement quantity. The movement quantity could be for example a torque and/or a force and/or an acceleration and/or a velocity. This in particular allows reliable provision of the lifting force.

For example the transmission unit could have a crank transmission and/or a wheel transmission and/or a roller transmission and/or a worm transmission. The transmission unit preferably has a cam transmission. In particular the ventilation unit provides a rotation movement for ventilation. In particular the ventilation unit brings about the lifting force, in particular the lifting force acting on the side region of the closing unit, by the rotation movement for ventilation. This means in particular that there is no need for a slotted guide.

It is further proposed that the cam transmission has at least one driven cam and at least one guide element driven by the cam. In particular the guide element provides at least one guide path to guide the cam for ventilation. The cam performs a rotation movement in particular for ventilation. In particular the cam has at least one first cam element and at least one second cam element. The cam has in particular an at least substantially L-shaped configuration, which is defined in particular by the cam elements. In particular the cam elements are connected to one another in a bonded manner. The cam is in particular configured as a single piece. "As a single piece" means in particular connected at least in a bonded manner, for example by a welding process, an adhesion process and/or a spraying process and/or advantageously shaped in a single piece, for example by being produced from one cast and/or by being produced using a single or multiple component injection procedure and advantageously from a single workpiece. In particular the first cam element drives the guide element. In particular the first cam element moves along the guide surface provided by the guide element. For ventilation the cam, in particular the first cam element of the cam, and the guide element, in particular the guide surface provided by the guide element, are arranged so that they are at least partially in contact with one another. This in particular allows particularly advantageous ventilation of the storage chamber.

For example the domestic refrigeration appliance apparatus could have at least one in particular rotatably mounted operating element, which could be provided in particular to drive the cam and in particular to be actuated by an operator. The operating element could in particular engage with the cam, in particular indirectly and/or directly, by use of at least one toothed wheel. Alternatively or additionally the operating element could be connected to the cam in a rotationally fixed manner, for example by bonding and/or with a force fit and/or with a form fit. The ventilation unit preferably has at least one motor unit, which drives the cam. A "motor unit" refers in particular to a unit, which is provided to convert a form of energy, for example chemical energy and/or thermal energy and/or advantageously electrical energy, to kinetic energy. In particular the motor unit provides a rotation energy for ventilation. The transmission unit provides the lifting force in particular by the rotation movement provided by the motor unit. In particular the motor unit drives the cam in particular rotationally and advantageously by use of the rotation energy. In particular the motor unit is connected to the second cam element in a rotationally fixed manner in the mounted state. The motor unit has in particular at least one electric motor. For example the motor unit could have a dedicated control unit, in particular one that is separate from an appliance controller. Alternatively or additionally the motor unit could be connected to an appliance controller. This in particular reduces the cost of the configuration. In particular an opening width of the closing unit relative to the storage unit can be set in an at least substantially infinitely adjustable or continuous manner. Alternatively or additionally the opening width of the closing unit relative to the storage unit can be set in steps or discontinuously. For example there can be two or three settings for the opening width, so that a setting can be stepped over two steps or three steps. The three steps can be referred to for example as closed, half-open and fully open. The two steps can be differentiated for example as "closed" and "open". It is also possible to have four, five or six steps for a setting.

For example the domestic refrigeration appliance apparatus could have at least one compartment base, to which the guide element could in particular be connected in at least one mounted state and/or to which the guide element could in particular be fastened in at least one mounted state. The guide element is preferably connected to the closing unit in at least one mounted state. In the mounted state the guide element could be connected to the closing unit for example in a bonded manner, in particular as a single piece and/or by an adhesive connection. In the mounted state the guide element is advantageously connected to the closing unit with a force fit and/or with a form fit. In particular the guide element is connected to the closing unit in such a manner that it cannot be moved relative to the closing unit in the mounted state. For example the guide element could be connected to the closing unit by a screw connection and/or by a rivet connection and/or by a connection brought about by locking in the mounted state. The guide element is advantageously connected to the closing unit by a latching connection in the mounted state, allowing in particular a high level of flexibility. Connecting the guide element to the closing unit in particular allows a high level of stability to be achieved.

It is further proposed that the guide element has at least one at least helical path, which in particular at least substantially defines the guide path and along which the cam in particular moves. In particular the guide element has an engagement cutout, in which the cam in particular engages and around which the helical path is arranged. This allows in particular a particularly effective and/or space-saving configuration.

It is also proposed that the domestic refrigeration appliance apparatus has at least one retaining unit, which at least substantially prevents movement of the closing unit at least in the horizontal direction at least during movement of the storage unit in a horizontal direction, in particular when the storage unit is pulled out of a refrigeration chamber in the horizontal direction. For example the retaining unit could be arranged on a rear wall that at least partially bounds the refrigeration chamber and in particular be connected at least partially to the closing unit and in particular at least substantially prevent movement of the closing unit in the horizontal direction by a retaining force counter to the movement of the closing unit. The retaining unit advantageously provides a stop for the closing unit and at least substantially prevents movement of the closing unit at least in the horizontal direction in particular by the stop. The retaining unit is in particular arranged on a region of the closing unit facing away from a rear wall that at least partially bounds the refrigeration chamber. In an installed position the horizontal direction is in particular aligned at least substantially parallel to the base. This is particularly user-friendly and/or saves the operator work in particular in the form of raising the closing unit relative to the storage unit.

It is also proposed that the retaining unit has at least one retaining element, which at least partially defines the pivot axis. The retaining element supports the closing unit in particular in a pivotable manner relative to the storage unit. The retaining unit and in particular the retaining element is/are in particular arranged on a further side region opposite the side region. In particular the closing unit has at least one coupling element. In particular the coupling element is connected to the retaining element in the mounted state and in particular retained by the retaining element and/or supported in a pivotable manner by the retaining element. The coupling element in particular at least partially defines the pivot axis. This means that there is no need in particular for further parts, which could be provided to define the pivot axis, thereby allowing costs in particular to be kept low.

It is further proposed that the domestic refrigeration appliance apparatus has at least one compartment base, to which the ventilation unit and in particular also the retaining unit is/are at least partially fastened in at least one mounted state. The compartment base could be provided for example to separate at least two refrigeration chambers from one another, it being possible for the compartment base in particular to be provided to define a bottom for a first refrigeration chamber and a top for a second refrigeration chamber. Alternatively the compartment base could be provided to separate at least two temperature zones of an in particular single refrigeration chamber from one another. In particular the compartment base could alternatively or additionally be provided to hold chilled goods and/or food standing up or lying down. The ventilation unit in particular connects the compartment base and the closing unit to one another in particular by means of the transmission unit. The motor unit is arranged on and in particular fastened to the compartment base and the guide element is arranged on and in particular fastened to the closing unit. In particular the second cam element of the cam is arranged so that it is in contact with the motor unit and the first cam element of the cam is arranged so that it is in contact met the guide path of the guide element. The ventilation unit and the retaining unit are fastened in particular to opposing ends of the compartment base.

This means that the ventilation unit can be arranged in such a manner that it is in particular at least partially protected and/or allows a stable configuration to be achieved.

The domestic refrigeration appliance apparatus could have for example a user interface, which could be provided in particular for an inputting of operating parameters and in particular for an outputting of operating parameters. In particular the user interface could have at least one output unit, which could be provided at least for outputting in an optical manner. The domestic refrigeration appliance apparatus could in particular have a control unit, which could be provided in particular at least to control and/or regulate the ventilation unit. In particular the control unit could be provided to activate the ventilation unit as a function of operator input by the user interface and in particular to set a position of the closing unit relative to the storage unit by the ventilation unit.

Particularly efficient storage of food can be achieved by a domestic refrigeration appliance with at least one inventive domestic refrigeration appliance apparatus.

Efficiency in respect of storing food can be further enhanced in particular by a method for operating an inventive domestic refrigeration appliance apparatus, with a storage unit, which defines at least one storage chamber for storing food that is open in the direction of an upper face of the storage unit, and with a closing unit, which, in at least one first storage state, closes the storage unit at least substantially in the direction of the upper face, with the closing unit being moved relative to the storage unit in at least one second storage state to ventilate the storage chamber and the closing unit being pivoted about a pivot axis relative to the storage unit to ventilate the storage chamber.

The domestic refrigeration appliance apparatus here should not be restricted to the application and embodiment described above. In particular the domestic refrigeration appliance apparatus can have a number of individual elements, parts and units that is different from the number specified herein to achieve a mode of operation described herein.

Other features which are considered as characteristic for the invention are set forth in the appended claims.

Although the invention is illustrated and described herein as embodied in domestic refrigeration appliance apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
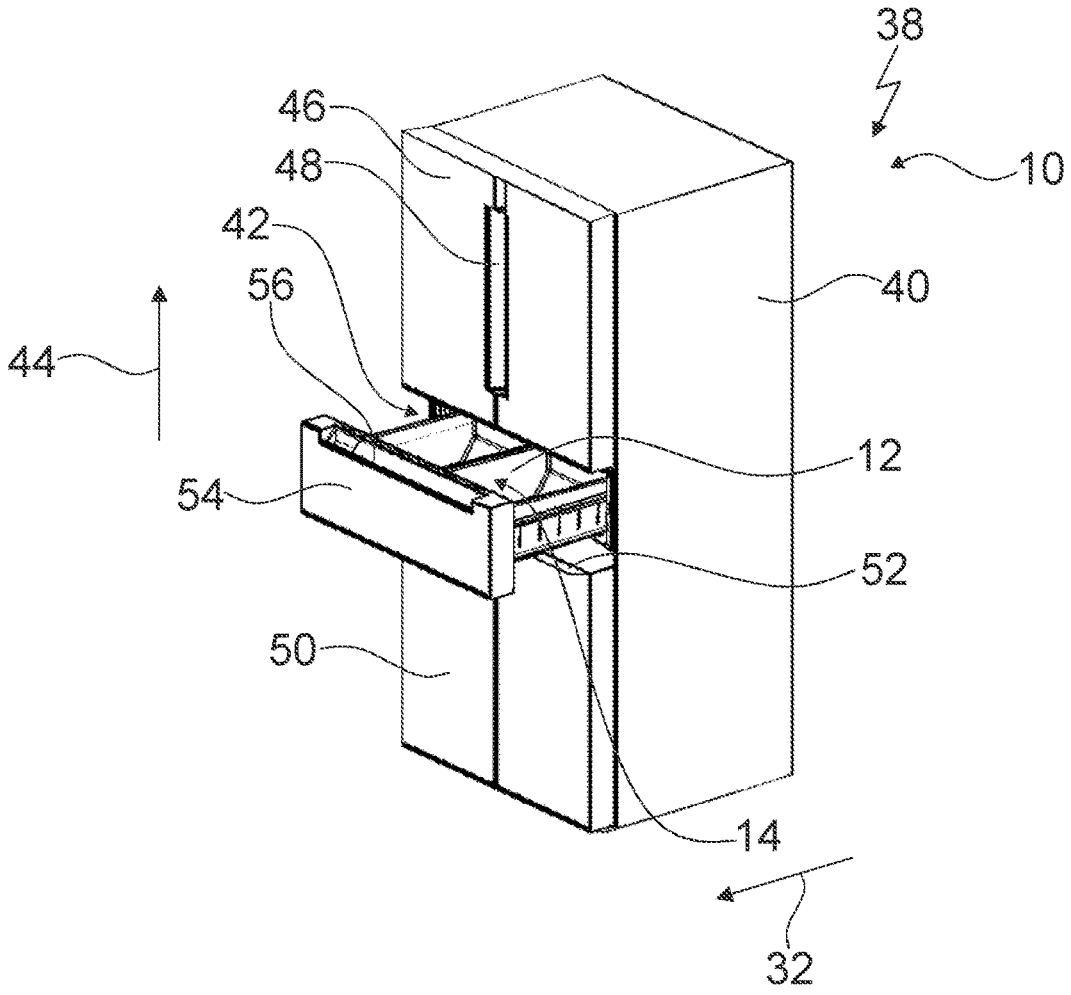
FIG. 1 is a perspective view of a domestic refrigeration appliance with a domestic refrigeration appliance apparatus according to the invention.

Referring now to the figures of the drawings in detail and first, particularly to FIG. 1 thereof, there is shown a domestic refrigeration appliance 38 with a domestic refrigeration appliance apparatus 10. The domestic refrigeration appliance 38 is configured as a refrigerator and as a freezer, in particular as combined refrigerator/freezer appliance.

The domestic refrigeration appliance apparatus 10 has a domestic appliance carcass or body 40. The domestic appliance body 40 partially defines three refrigeration chambers 42 (see FIGS. 1 and 2). Only one of the refrigeration chambers 42 is shown in the figures. The refrigeration chambers 42 are arranged one above the other in respect of a vertical direction 44 in an installed position. The vertical direction 44 is aligned substantially perpendicular to a base.

A first refrigeration chamber 42 of the refrigeration chambers 42 is configured as a first food receiving chamber (not shown). The first refrigeration chamber 42 is configured as a chiller chamber. The domestic refrigeration appliance apparatus 10 has two first appliance doors 46. Only one of any objects that are present a number of times in the figures is shown with a reference character. The first appliance doors 46 are supported in a pivotable manner relative to the domestic appliance carcass 40. In a closed state the first appliance doors 46 close the first refrigeration chamber 42. The domestic refrigeration appliance apparatus 10 has two first door handles 48. The first door handles 48 are provided to move the first appliance doors 46 relative to the domestic appliance body 40.

A second refrigeration chamber 42 of the refrigeration chambers 42 is configured as a second food receiving chamber (not shown). The second refrigeration chamber 42 is configured as a freezer chamber. The domestic refrigeration appliance apparatus 10 has two second appliance doors 50. The second appliance doors 50 are supported in a pivotable manner relative to the domestic appliance carcass 40. In a closed state the second appliance doors 50 close the second refrigeration chamber 42. The domestic refrigeration appliance apparatus 10 has two second door handles 52. The second door handles 52 are provided to move the second appliance doors 50 relative to the domestic appliance carcass 40.

A third refrigeration chamber 42 of the refrigeration chambers 42 is configured as a third food receiving chamber (see FIG. 1). The third refrigeration chamber 42 is configured as a keep-fresh chamber. The domestic refrigeration appliance apparatus 10 has a third appliance door 54. The third appliance door 54 is mounted in such a manner that it can be moved, in particular displaced and/or pulled out, relative to the domestic appliance carcass 40 by a translatory movement. In a closed state the third appliance door 54 closes the third refrigeration chamber 42. The domestic refrigeration appliance apparatus 10 has a third door handle 56. The third door handle 56 is provided to move the third appliance door 54 relative to the domestic appliance carcass 40.

The second refrigeration chamber 42 is arranged below the first refrigeration chamber 42 in respect of the vertical direction 44 in an installed position. The third refrigeration chamber 42 is arranged between the first refrigeration chamber 42 and the second refrigeration chamber 42 in respect of the vertical direction 44 in the installed position.

The domestic refrigeration appliance apparatus 10 has two storage units 12. In an operating state the storage units 12 are arranged within the third refrigeration chamber 42. The storage units 12 are arranged directly adjacent to one another (see FIGS. 1 and 2).

Figure 9:
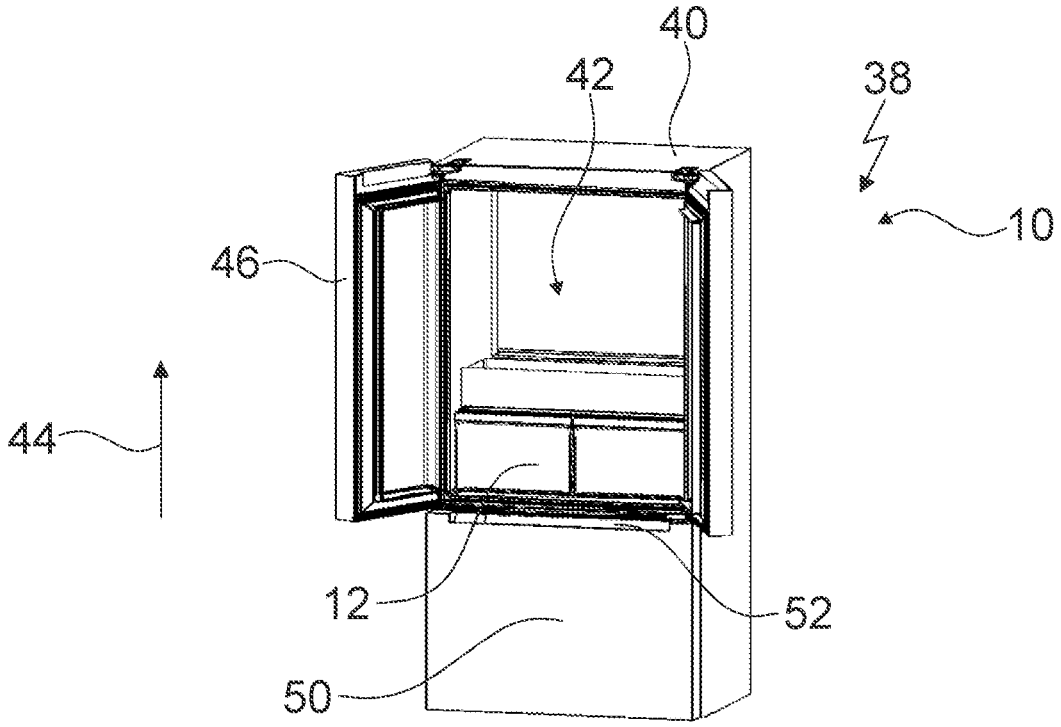
FIG. 9 is a schematic perspective view of an alternative domestic refrigeration appliance with the domestic refrigeration appliance apparatus.

As an alternative to the configuration of the domestic refrigeration appliance according to FIG. 1 the domestic refrigeration appliance could be configured as an alternative domestic refrigeration appliance as shown in FIG. 9. The alternative domestic refrigeration appliance has a domestic appliance carcass, which partially defines two refrigeration chambers. A first refrigeration chamber of the refrigeration chambers is configured as a first food receiving chamber, which contains a chiller chamber and a keep-fresh chamber. A second refrigeration chamber of the refrigeration chambers is configured as a second food receiving chamber, which is configured as a freezer chamber. The storage units are arranged in the first refrigeration chamber.

Only one of the refrigeration chambers 42 and one of the appliance doors 46, 50, 54 is described in the following. Also only one of the storage units 12 and only one object relating to each described storage unit 12 is described in the following, for example a ventilation unit and/or a closing unit.

The storage unit 12 defines a storage chamber 14 for storing food that is open in the direction of an upper face of the storage unit 12. The storage chamber 14 is configured as a keep-fresh chamber. The storage unit 12 is configured as a drawer. In an operating state storage unit 12 is supported in such a manner that it can be pulled out.

The appliance door 54 is provided to move the storage unit 12. The storage unit 12 is coupled to a movement of the appliance door 54. In an operating state the storage unit 12 is arranged within the refrigeration chamber 42. The appliance door 54 is closed in the operating state. There are two different storage states in the operating state (see FIGS. 3 and 4).

The domestic refrigeration appliance apparatus 10 has a closing unit 16 (see FIGS. 2 to 5). The closing unit 16 is arranged above the storage unit 12 in respect of the vertical direction 44 in the installed position. In a first storage state the closing unit 16 substantially closes the storage unit 12 in the direction of the upper face. The closing unit 16 forms a lid for the storage unit 12. In the first storage state the closing unit 16 prevents an exchange of air between the storage chamber 14 and the refrigeration chamber 42.

The domestic refrigeration appliance apparatus 10 has a ventilation unit 18 (see FIGS. 2 to 8). In a second storage state the ventilation unit 18 moves the closing unit 16 relative to the storage unit 12 to ventilate the storage chamber 14. In the second storage state the ventilation unit 18 allows an exchange of air between the storage chamber 14 and the refrigeration chamber 42.

Figure 3:
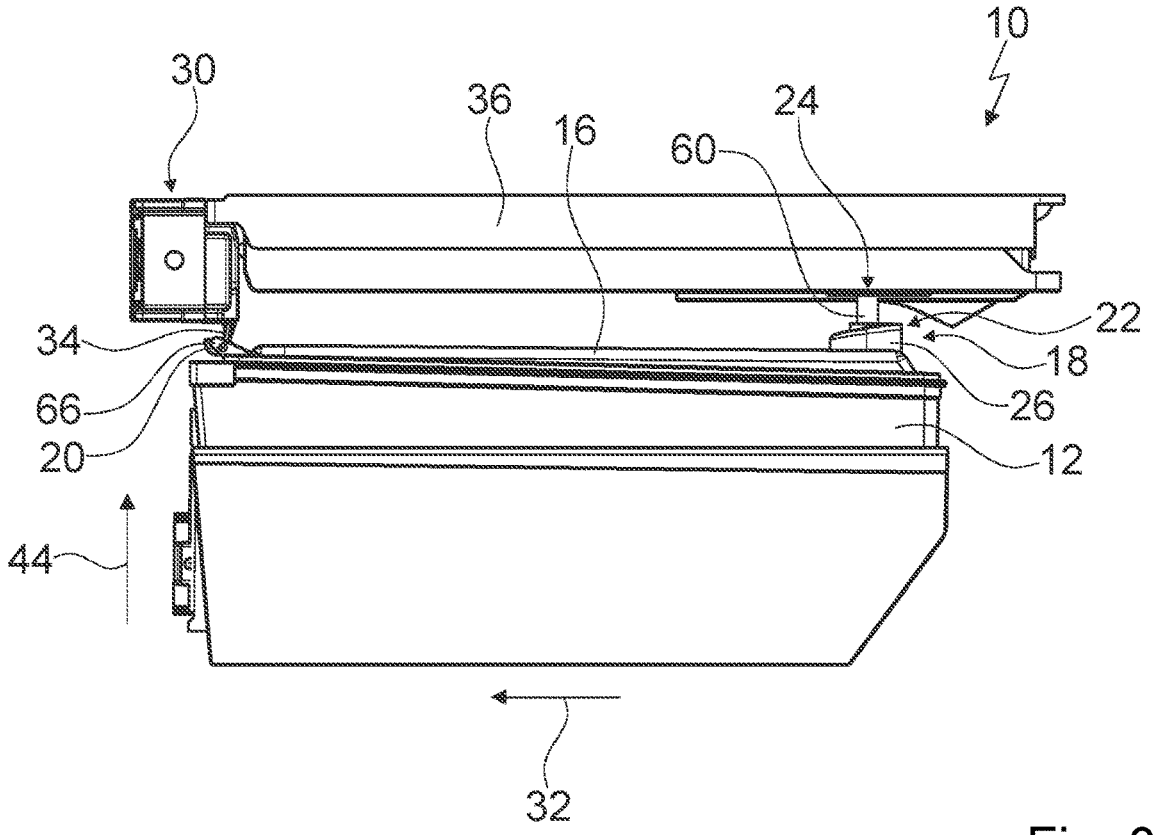
FIG. 3 is a side, perspective view of the compartment base, one of the storage units, one of the closing units, one of the ventilation units and one of the retaining units in a first storage state.
Figure 4:
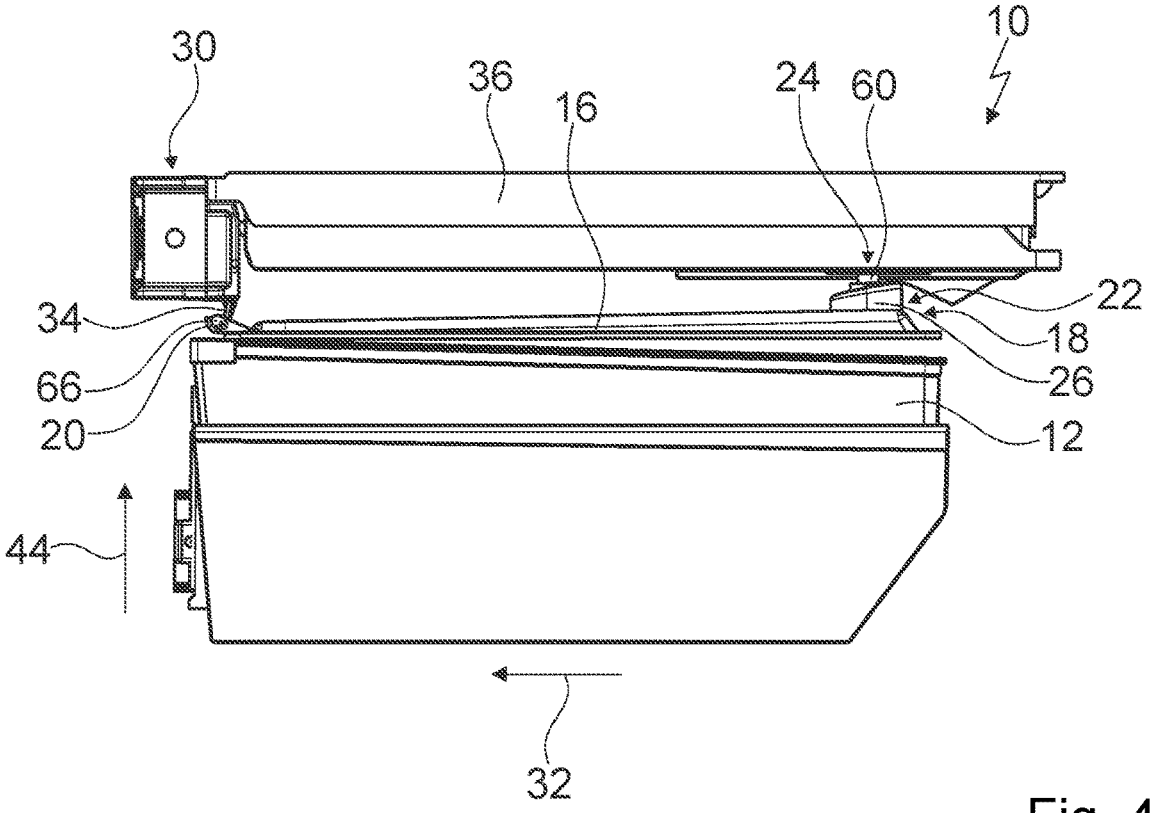
FIG. 4 is a side, perspective view of the compartment base, the storage unit, the closing unit, the ventilation unit and the retaining unit in a second storage state.

To ventilate the storage chamber 14 the ventilation unit 18 pivots the closing unit 16 about a pivot axis 20 relative to the storage unit 12 (see FIGS. 3 and 4). The ventilation unit 18 acts on a side region of the closing unit 16.

In the present exemplary embodiment the ventilation unit 18 acts on a side region of the closing unit 16 facing a rear wall of the domestic appliance carcass 40 defining the refrigeration chamber 42. The ventilation unit 18 provides a lifting force acting on the side region of the closing unit 16 for ventilation. The lifting force and the vertical direction 44 are aligned substantially parallel to one another at least in the first storage state.

The ventilation unit 18 has a transmission unit 22 to provide the lifting force. The ventilation unit 18 provides the lifting force by means of the transmission unit 22. In the present exemplary embodiment the transmission unit 22 has a cam transmission.

Figure 6:
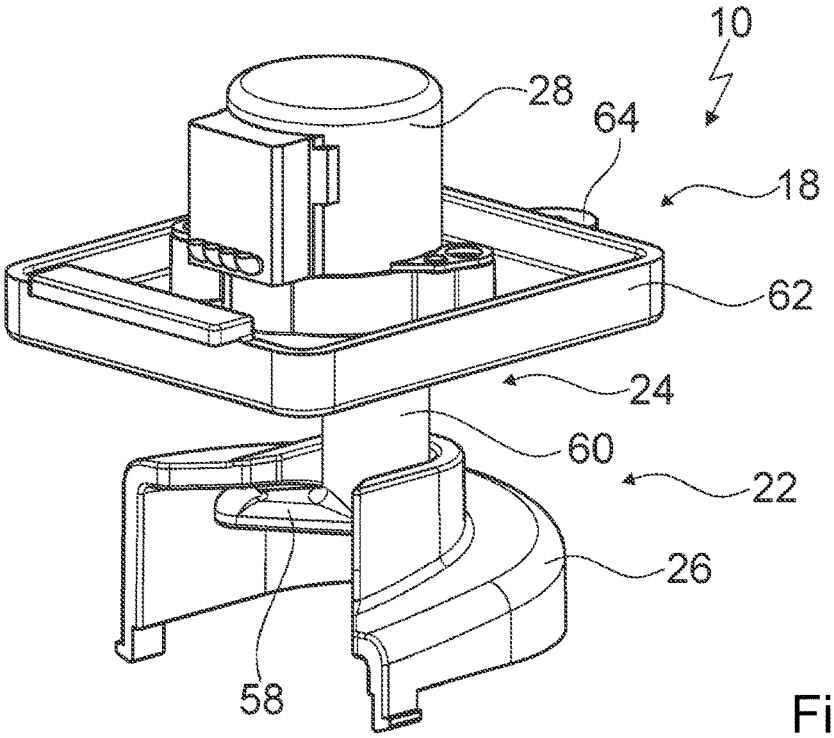
FIG. 6 is a perspective view of a transmission unit of the ventilation unit and a motor unit of the ventilation unit.
Figure 7:
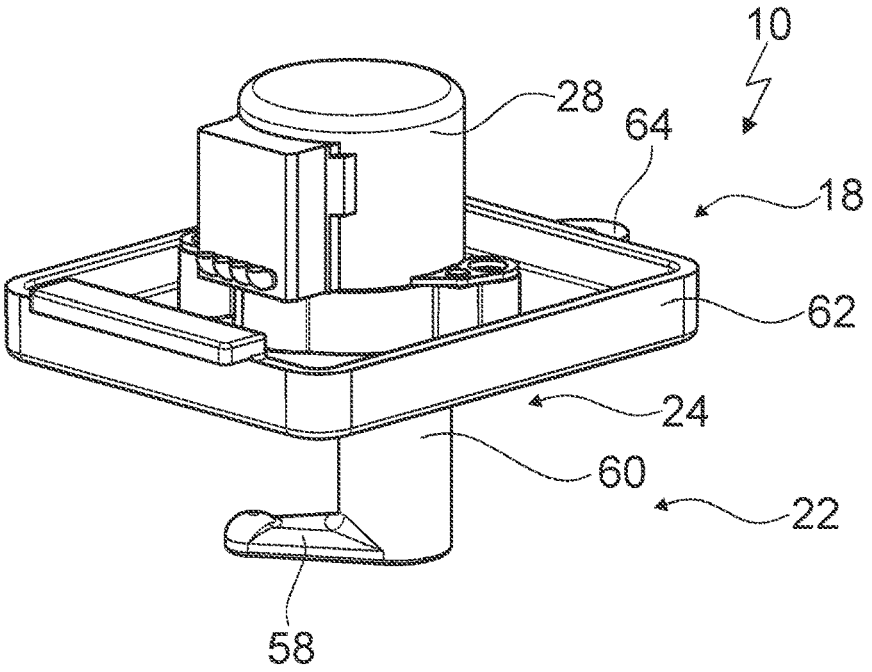
FIG. 7 is a perspective view of a cam of the transmission unit, a motor bearing element of the transmission unit and the motor unit.
Figure 8:
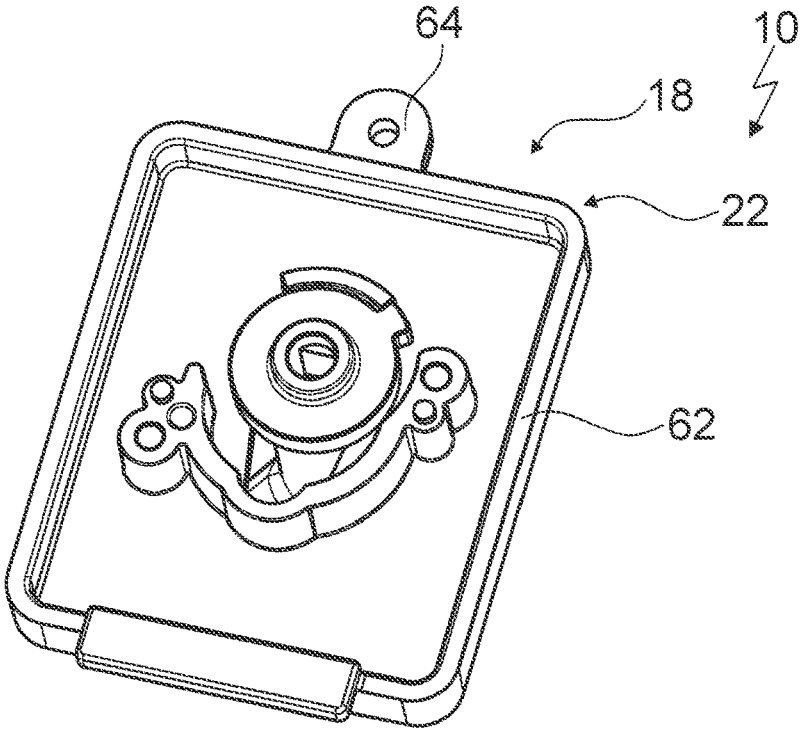
FIG. 8 is a perspective view of the motor bearing element.

The cam transmission has a cam 24 (see FIGS. 6 and 7). The cam 24 has a substantially L-shaped configuration. The cam 24 has a first cam element 58 and a second cam element 60. The first cam element 58 has a main extension direction, which is aligned substantially perpendicular to a main extension direction of the second cam element 60. The first cam element 58 is provided to drive a guide element 26 of the cam transmission.

The cam transmission has the guide element 26, which is driven by the cam 24 (see FIGS. 2 to 6). The guide element 26 is provided for a connection to the closing unit 16. In a mounted state the guide element 26 is connected to the closing unit 16. In the present exemplary embodiment the guide element 26 is connected to the closing unit 16 by a latching connection in the mounted state.

The guide element 26 has a helical path. The guide element 26 provides a guide path to guide the cam 24 by means of the helical path. The cam 24 slides along the guide path defined by the helical path by means of the first cam element 58. The cam 24 drives the guide element 26 along the guide path of the guide element 26 by means of a movement.

Figure 5:
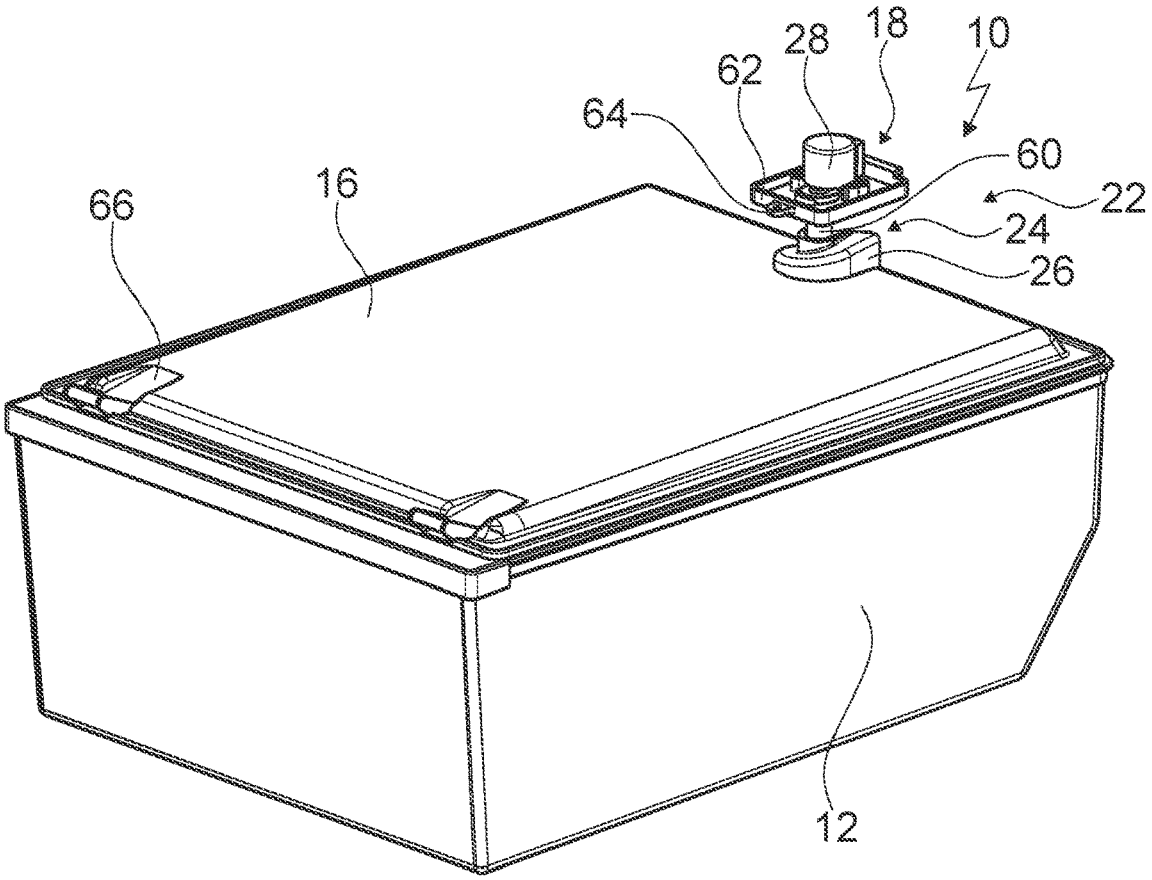
FIG. 5 is a perspective view of the storage unit, the closing unit and the ventilation unit in the first storage state.

The ventilation unit 18 has a motor unit 28 (see FIGS. 5 to 7). The motor unit 28 drives the cam 24. The cam 24 and the motor unit 28 are connected to one another in a rotationally fixed manner. The motor unit 28 and the second cam element 60 are connected to one another in a rotationally fixed manner. The motor unit 28 provides a rotation force to drive the cam 24.

The transmission unit 22 has a motor bearing element 62. The motor bearing element 62 is configured as substantially plate-like. In the mounted state the motor unit 28 is connected to the transmission unit 22. The motor unit 28 is connected to the motor bearing element 62 in the mounted state. In the installed position the motor unit 28 is arranged above the motor bearing element 62. The cam 24 is connected to the motor unit 28 by way of the motor bearing element 62.

Figure 2:
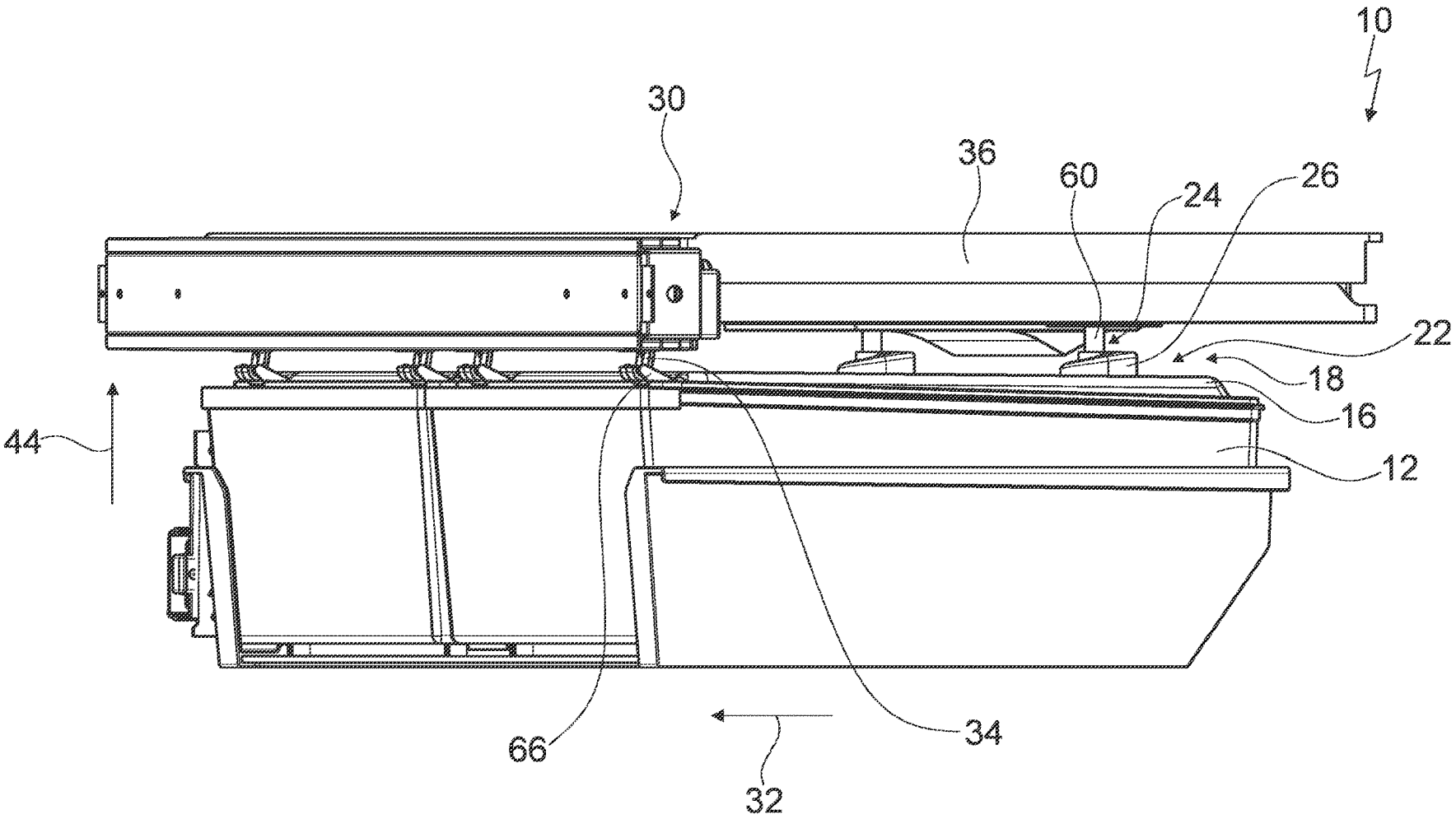
FIG. 2 is a perspective view of a compartment base, two storage units, two closing units, two ventilation units and two retaining units of the domestic refrigeration appliance apparatus.

The domestic refrigeration appliance apparatus 10 has a compartment base 36 (see FIGS. 2 to 4). The compartment base 36 is provided to delimit different refrigeration chambers 42. In the present exemplary embodiment the compartment base 36 separates the first refrigeration chamber 42 and the third refrigeration chamber 42 from one another.

In the mounted state the ventilation unit 18 is partially fastened to the compartment base 36. The ventilation unit 18 has a fastening element 64 for fastening to the compartment base 36. The fastening element 64 is arranged on the motor bearing element 62. The fastening element 64 and the motor bearing element 62 are configured as a single piece.

The domestic refrigeration appliance apparatus 10 has a retaining unit 30 (see FIGS. 2 to 4). In the mounted state the retaining unit 30 is fastened to the compartment base 36. When the storage unit 12 is moved in a horizontal direction 32, the retaining unit 30 substantially prevents movement of the closing unit 16 in the horizontal direction 32.

The retaining unit 30 has a retaining element 34. In the installed position the retaining element 34 extends parallel to the vertical direction 44 from the compartment base 36 in the direction of the closing unit 16. The retaining element 34 engages with the closing unit 16 in the mounted state.

The closing unit 16 has a coupling element 66. In the mounted state the coupling element 66 engages with the retaining element 34. The retaining element 34 partially defines the pivot axis 20, about which the closing unit 16 is pivotably supported. In the mounted state the coupling element 66 is supported by the retaining element 34 in a pivotable manner. The coupling element 66 and the retaining element 34 together define the pivot axis 20.

In a method for operating the domestic refrigeration appliance apparatus 10 the closing unit 16 is moved relative to the storage unit 12 in the second storage state to ventilate the storage chamber 14. In the method the closing unit 16 is pivoted about the pivot axis 20 relative to the storage unit 12 to ventilate the storage chamber 14.

The following is a summary list of reference numerals and the corresponding structure used in the above description of the invention:

10 Domestic refrigeration appliance apparatus
12 Storage unit
14 Storage chamber
16 Closing unit
18 Ventilation unit
20 Pivot axis
22 Transmission unit

24 Cam
26 Guide element
28 Motor unit
30 Retaining unit
32 Horizontal direction
34 Retaining element
36 Compartment base
38 Domestic refrigeration appliance
40 Domestic appliance carcass
42 Refrigeration chamber
44 Vertical direction
46 First appliance door
48 First door handle
50 Second appliance door
52 Second door handle
54 Third appliance door
56 Third door handle
58 First cam element
60 Second cam element
62 Motor bearing element
64 Fastening element
66 Coupling element

The invention claimed is:

1. A domestic refrigeration appliance apparatus, comprising:

a storage unit defining at least one storage chamber for storing food, said storage chamber having an upper face and being open in a direction of said upper face of said storage unit, said storage chamber being movable out of the appliance apparatus in a removal direction, said storage chamber having a front side being a leading side in the removal direction, said upper face having a negative slope from said front side rearward;

a lid, which in at least one first storage state closes against said upper face for completely closing said storage chamber;

a ventilation unit which in at least one second storage state moves said lid relative to said storage unit lifting said lid from said upper face for ventilating said storage chamber, said ventilation unit having a pivot axis disposed at said front side of said storage chamber, said ventilation unit pivoting said lid about the pivot axis relative to said storage unit to ventilate said storage chamber, said ventilation unit having a transmission providing a lifting force by means of said transmission, said transmission having a cam mechanism with at least one driven cam and at least one guide driven by said driven cam, said at least one guide having a helical path defining a guide path along which said at least one driven cam slides, said driven cam performing a rotational movement for ventilating said storage unit, said ventilation unit further having at least one motor unit driving said driven cam; and said guide connected to said lid in such a manner that said guide cannot be moved relative to said lid.

2. The domestic refrigeration appliance apparatus according to claim 1, wherein said ventilation unit provides the lifting force which acts on a side region of said lid for ventilation.

3. The domestic refrigeration appliance apparatus according to claim 1, wherein said guide is connected to said lid in at least one mounted state.

4. The domestic refrigeration appliance apparatus according to claim 1, further comprising at least one retainer which maintains said lid in place when said storage unit is moved in the horizontal direction.

5. The domestic refrigeration appliance apparatus according to claim 4, wherein said retainer has at least one retaining element which at least partially defines the pivot axis.

6. A domestic refrigeration appliance, comprising: a domestic refrigeration appliance apparatus, containing:

a storage unit defining at least one storage chamber for storing food, said storage chamber having an upper face and being open in a direction of said upper face of said storage unit, said storage chamber being movable out of the appliance apparatus in a removal direction, said storage chamber having a front side being a leading side in the removal direction, said upper face having a negative slope from said front side rearward;

a lid, which in at least one first storage state closes against said upper face for completely closing said storage chamber;

a ventilation unit which in at least one second storage state moves said lid relative to said storage unit to ventilate said storage chamber, said ventilation unit having a pivot axis disposed at said front side of said storage chamber, said ventilation unit pivoting said lid about the pivot axis relative to said storage unit lifting said lid from said upper face for ventilating said storage chamber, said ventilation unit having a transmission providing a lifting force by means of said transmission, said transmission having a cam mechanism with at least one driven cam and at least one guide driven by said driven cam, said at least one guide having a helical path defining a guide path along which said at least one driven cam slides, said driven cam performing a rotational movement for ventilating said storage unit, said ventilation unit further having at least one motor unit driving said driven cam; and said guide connected to said lid in such a manner that said guide cannot be moved relative to said lid.

7. A method for operating a domestic refrigeration appliance apparatus comprising:

providing the appliance according to claim 1;

moving the lid to at least one first storage state for closing the storage unit at least substantially in the direction of the upper face;

moving the lid relative to the storage unit in at least one second storage state to ventilate the storage chamber; and pivoting the lid about a pivot axis relative to the storage unit to ventilate the storage chamber.

* * * * *